US009195189B2

(12) United States Patent
Hazeyama et al.

(10) Patent No.: US 9,195,189 B2
(45) Date of Patent: Nov. 24, 2015

(54) FIXING DEVICE

(71) Applicant: Brother Kogyo Kabushiki Kaisha, Nagoya-shi, Aichi-ken (JP)

(72) Inventors: Tomoaki Hazeyama, Yokkaichi (JP); Yuji Nishigaki, Hashima (JP); Yasuhiro Maruyama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/745,789

(22) Filed: Jun. 22, 2015

(65) Prior Publication Data

US 2015/0286177 A1 Oct. 8, 2015

Related U.S. Application Data

(63) Continuation of application No. 14/018,788, filed on Sep. 5, 2013, now Pat. No. 9,063,485.

(30) Foreign Application Priority Data

Sep. 26, 2012 (JP) ..... 2012-211845
Sep. 26, 2012 (JP) ..... 2012-211847

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2017; G03G 15/2053; G03G 2215/2035
USPC ..... 399/122, 320, 329, 336
See application file for complete search history.

(56) References Cited

U.S. PATENT DOCUMENTS

2009/0110451 A1 4/2009 Jung et al.
2011/0158718 A1* 6/2011 Fujiwara et al. ..... 399/329
2011/0158719 A1* 6/2011 Miyauchi et al. ..... 399/329

(Continued)

FOREIGN PATENT DOCUMENTS

JP 2003-084602 A 3/2003
JP 2011-095534 A 5/2011

(Continued)

OTHER PUBLICATIONS

Co-Pending U.S. Appl. No. 14/018,734, filed Sep. 5, 2013.

*Primary Examiner* — Francis Gray
(74) *Attorney, Agent, or Firm* — Banner & Witcoff, Ltd.

(57) ABSTRACT

A fixing device configured to thermally fix a developing agent image to a recording sheet includes a fixing belt having a tubular shape defining an inner space, a heat generating member, a nip member, and a stay which are disposed in the inner space of the fixing belt, and a rotating member disposed outside the inner space of the fixing belt. The fixing belt is nipped between the nip plate and the rotating member. The stay comprises a first receiving portion and a second receiving portion which are positioned upstream and downstream of the heat generating member, respectively, in a conveying direction of the recording sheet and are configured to receive a force exerted from the rotating member to the nip member. The heat insulator is disposed between the nip member and one of the first receiving portion and the second receiving portion of the stay.

17 Claims, 14 Drawing Sheets

(56) References Cited

U.S. PATENT DOCUMENTS

| | | | | |
|---|---|---|---|---|
| 2011/0211876 | A1 | 9/2011 | Iwaya et al. | |
| 2011/0222931 | A1 | 9/2011 | Shinshi et al. | |
| 2011/0236088 | A1 | 9/2011 | Maruyama | |
| 2012/0275833 | A1* | 11/2012 | Ishida et al. | 399/329 |
| 2013/0071159 | A1* | 3/2013 | Suzuki et al. | 399/329 |
| 2013/0136511 | A1 | 5/2013 | Suzuki et al. | |
| 2013/0136513 | A1 | 5/2013 | Suzuki et al. | |

FOREIGN PATENT DOCUMENTS

| | | | |
|---|---|---|---|
| JP | 2011-113014 | A | 6/2011 |
| JP | 2011-203405 | A | 10/2011 |
| JP | 2013-114052 | A | 6/2013 |
| JP | 2013-114057 | A | 6/2013 |

* cited by examiner

FIXING DEVICE

CROSS REFERENCE TO RELATED APPLICATIONS

This application is a continuation of U.S. patent application Ser. No. 14/018,788, filed Sep. 5, 2013, which claims priority from Japanese Patent Application Nos. 2012-211845 and 2012-211847, filed on Sep. 26, 2012, the entire disclosures of which are incorporated herein by reference.

BACKGROUND OF THE INVENTION

1. Field of the Invention

The present invention relates to a fixing device configured to thermally fix a developing agent image to a recording sheet.

2. Description of Related Art

A known fixing device, which is configured to thermally fix a developing agent image to a recording sheet, comprises a tubular fixing belt, a heat generating member, a nip member, a pressure roller, and a stay. The heating generating member and the nip member are disposed in an inner space of the fixing belt. The fixing belt is nipped between the nip member and the pressure roller. The stay supports the nip member from a side opposite from the pressure roller.

In such a fixing device, the stay may take heat from the nip member, which may reduce heating efficiency of the nip member and especially adversely affect temperature rising of the nip member at the start of operation.

SUMMARY OF THE INVENTION

Therefore, a need has arisen for a fixing device which prevents or reduces heat transfer from a nip member to a stay during heating of the nip member, and allows heat to escape from the nip member to the stray during cooling of the nip member.

According to an embodiment of the invention, a fixing device configured to thermally fix a developing agent image to a recording sheet comprises a fixing belt having a tubular shape defining an inner space, a heat generating member disposed in the inner space of the fixing belt, a nip member made of metal and disposed in the inner space of the fixing belt such that an inner surface of the fixing belt is configured to make slide contact with the nip member, a rotating member configured to rotate and disposed outside the inner space of the fixing belt such that the fixing belt is nipped between the nip member and the rotating member, a stay made of metal and disposed in the inner space of the fixing belt, and a heat insulator made of a non-metallic material. The stay comprises a first receiving portion and a second receiving portion which are positioned upstream and downstream of the heat generating member, respectively, in a conveying direction of the recording sheet and are configured to receive a force exerted from the rotating member to the nip member. The heat insulator is disposed between the nip member and one of the first receiving portion and the second receiving portion of the stay.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-14, like numerals being used for like corresponding parts in the various drawings.

In the following description, the expressions "front", "rear", "upper (up)", "lower (down)", "right", and "left" are used to define the various parts when a laser printer 1, is disposed in an orientation in which it is intended to be used.

<General Structure of a Laser Printer>

Figure 1:
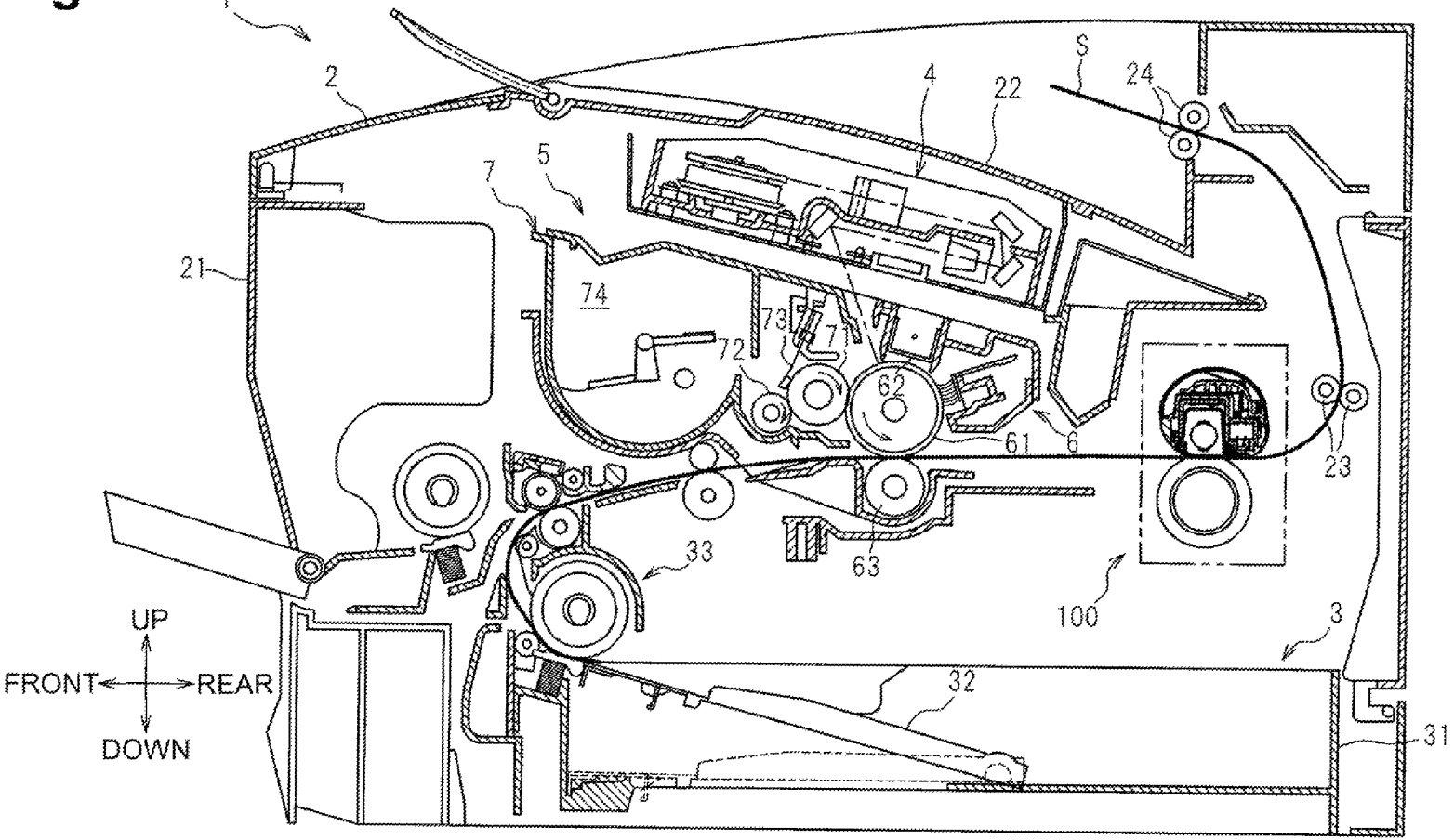
FIG. 1 is a schematic cross-sectional view showing a general structure of a laser printer including a fixing device, according to a first embodiment of the invention.

As shown in FIG. 1, the laser printer 1, according to a first embodiment of the invention, mainly includes, in a housing 2, a sheet feed unit 3 that feeds a recording sheet, e.g., a sheet S, an exposure device 4, a process cartridge 5 that transfers a toner image (a developing agent image) to the sheet S, and a fixing device 100 that thermally fixes the toner image on the sheet S.

The sheet feed unit 3, which is disposed at the bottom of the housing 2, mainly includes a feed tray 31, a sheet lifting plate 32, and a sheet feeding mechanism 33. A sheet S accommodated in the feed tray 31 is shifted upwardly by the sheet lifting plate 32 and is supplied toward the process cartridge 5 (specifically, a nip between a photosensitive drum 61 and a transfer roller 63) by the sheet feeding mechanism 33.

The exposure device 4, which is disposed at the upper part of the housing 2, includes a laser light emitting unit (not shown) as well as a polygon minor, a lens, and a reflecting minor, which are shown without reference numerals. In the exposure device 4, laser light (see the dash-dot line) emitted from the laser light emitting unit according to image data is scanned at high speed on the surface of the photosensitive drum 61 to expose the surface of the photosensitive drum 61 to light.

The process cartridge 5, which is disposed below the exposure device 4, is removably attached to the housing 2 through an opening made when a front cover 21 attached to the housing 2 is opened. The process cartridge 5 is formed with a drum unit 6 and a developing unit 7.

The drum unit 6 mainly includes the photosensitive drum 61, a charger 62, and the transfer roller 63. The developing unit 7, which is removably attached to the drum unit 6, mainly includes a developing roller 71, a supply roller 72, a blade 73, and a toner storage 74 that stores toner (a developing agent).

In the process cartridge 5, the surface of the photosensitive drum 61 is uniformly charged by the charger 62, after which laser light from the exposure device 4 is scanned at high speed on the photosensitive drum 61, so its surface is exposed to light, forming an electrostatic latent image on the photosensitive drum 61 according to the image data. Toner in the toner storage 74 is supplied through the supply roller 72 to the developing roller 71 and then enters between the developing roller 71 and the blade 73. The toner is supported on the developing roller 71 as a thin layer with a fixed thickness.

The toner supported on the developing roller 71 is supplied from the developing roller 71 to the electrostatic latent image formed on the photosensitive drum 61. Thus, the electrostatic latent image is visualized, forming a toner image on the photosensitive drum 61. When a sheet S is then conveyed between the photosensitive drum 61 and the transfer roller 63, the toner image on the photosensitive drum 61 is transferred to the sheet S.

The fixing device 100 is disposed behind the process cartridge 5. The toner image (toner) transferred to the sheet S is thermally fixed to the sheet S while the sheet S passes through the fixing device 100. The sheet S on which the toner image has been thermally fixed is discharged to a discharge tray 22 by convey rollers 23 and 24.

<Fixing Device in First Embodiment>

Figure 2:
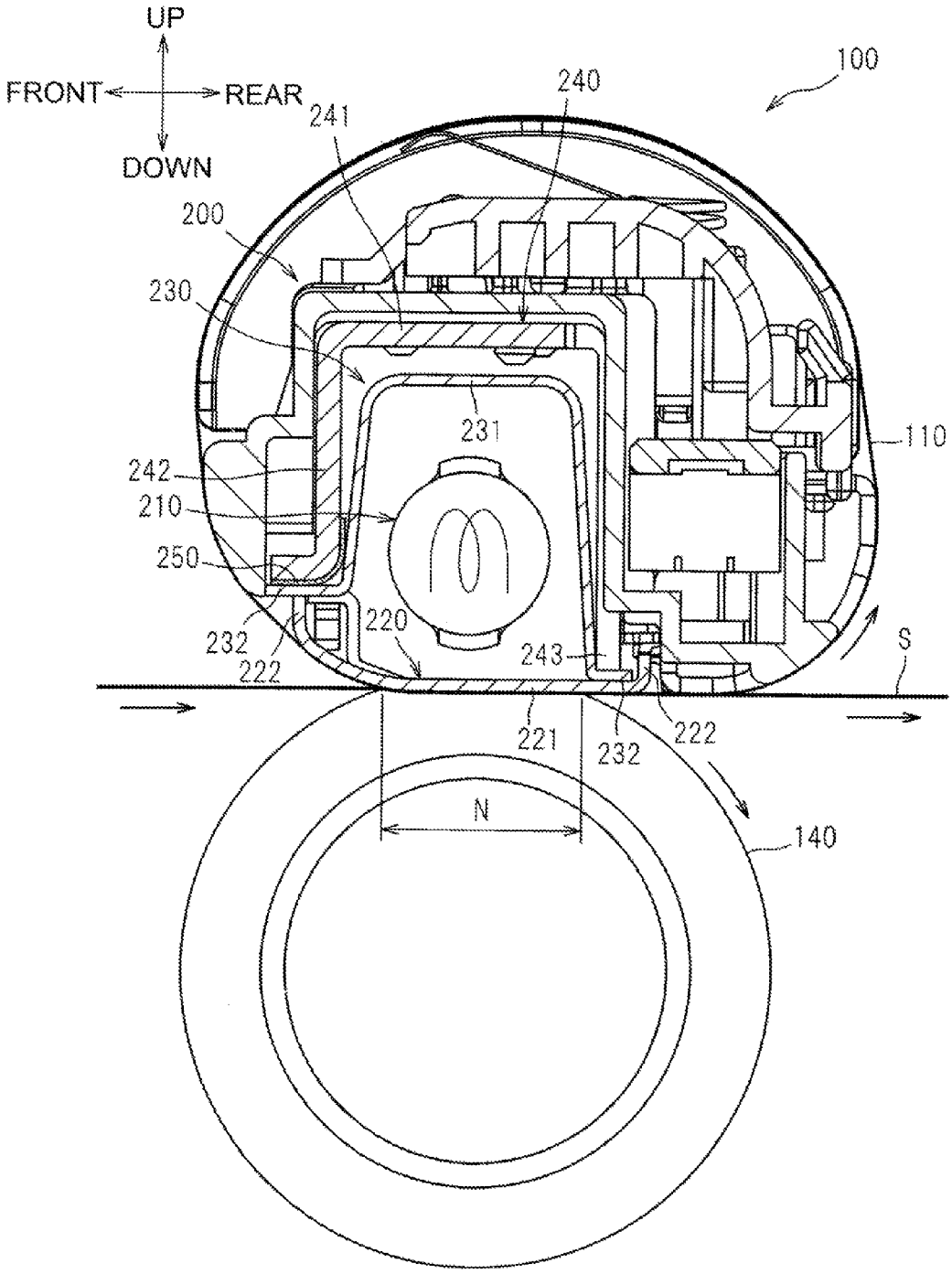
FIG. 2 is a cross-sectional view of the fixing device according to the first embodiment of the invention.

As shown in FIG. 2, the fixing device 100, according to the first embodiment of the invention, mainly includes a tubular fixing belt 110, a heating unit 200 that is disposed in an inner space defined by an inner peripheral surface of the fixing belt 110 and heats the fixing belt 110, and a rotating member, e.g., a pressure roller 120.

The fixing belt 110, which is heated by the heating unit 200 described later, is a belt having heat resistance and flexibility. The rotation of the fixing belt 110 is guided by a guide member, which is shown without a reference numeral.

The pressure roller 120, which can be elastically deformed, is disposed below the fixing belt 110 and the heating unit 200. When the pressure roller 120 is elastically deformed and nips the fixing belt 110 in cooperation with the heating unit 200 (particularly, a nip plate 220), a nip region N is formed. In this embodiment, the heating unit 200 and the pressure roller 120 are mutually brought into pressure contact while one of them is urged toward the other.

When a driving force is transmitted from a motor (not shown) provided in the housing 2 to the pressure roller 120, its rotation is driven. Then, the fixing belt 110 is rotated by a frictional force exerted between the pressure roller 120 and the fixing belt 110 (or the sheet S). Thus, while the sheet S, to which the toner image has been transferred, is conveyed from front to rear between the pressure roller 120 and the heated fixing belt 110, the toner image (toner) is thermally fixed to the sheet S.

The heating unit 200, which heats toner on the sheet S through the fixing belt 110, includes a heat generating member, e.g., a halogen lamp 210, a nip member, e.g., the nip plate 220, a reflective member 230, and a stay 240.

The halogen lamp 210 is a heater that generates radiant heat and heats the nip plate 220 and the fixing belt 110, thereby to heat the toner on the sheet S. The halogen lamp 210 is disposed in the inner space defined by the fixing belt 110 with prescribed spacing from the fixing belt 110 and from the inner face of the nip plate 220.

The nip plate 220 is a plate-shaped member made of metal and receives radiant heat from the halogen lamp 210. The nip plate 220 is disposed in the inner space defined by the fixing belt 110 such that the inner peripheral surface of the tubular fixing belt 110 makes sliding contact with the lower face of the nip plate 220. In this embodiment, the nip plate 220 is formed by machining an aluminum plate, or a plate made of other material, having higher thermal conductivity than the steel stay 240 described later.

Figure 3:
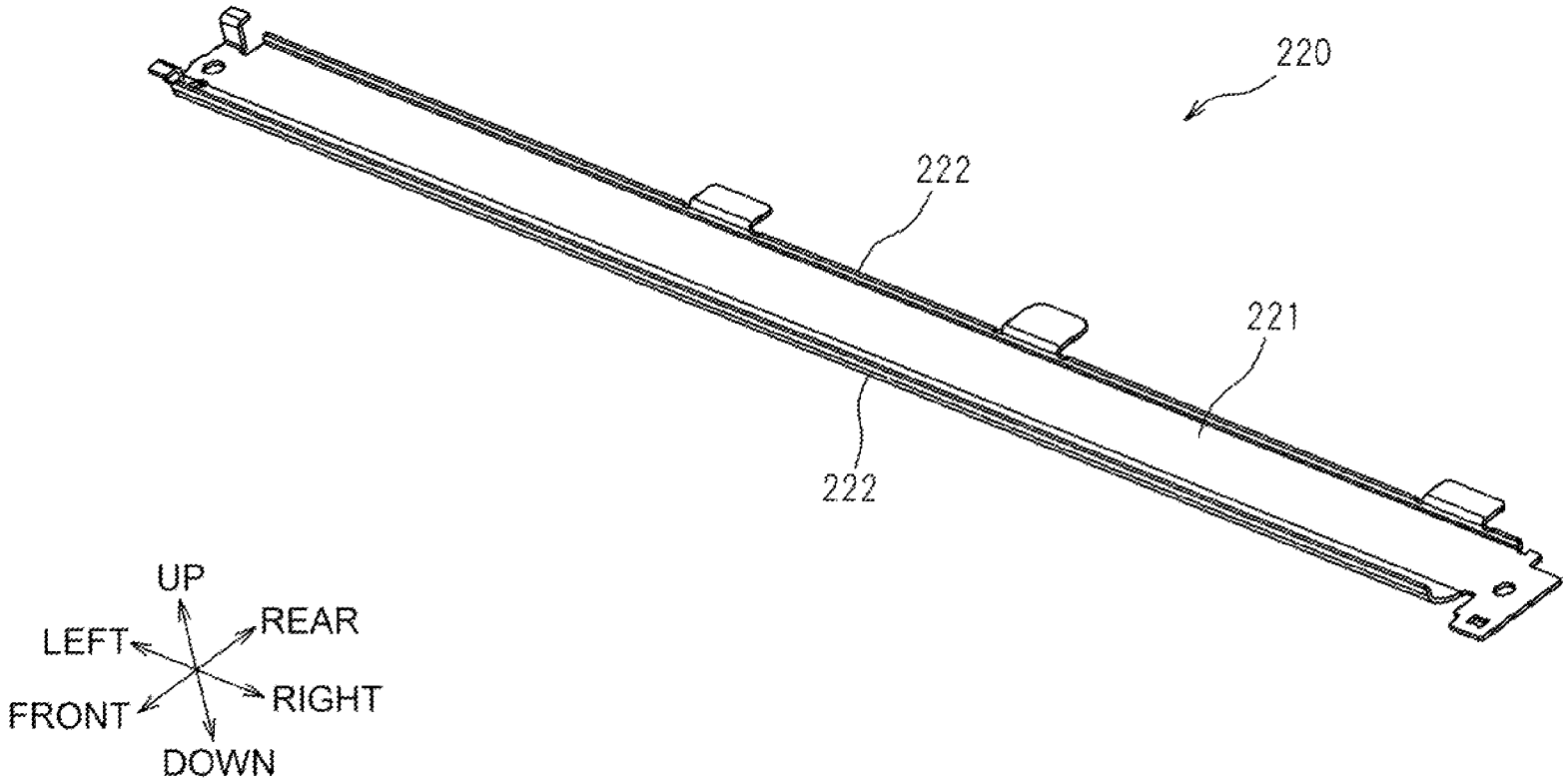
FIG. 3 is a perspective view of a nip plate of the fixing device, according to the first embodiment of the invention.

As shown in FIG. 3, the nip plate 220 includes a base portion 221, which is formed like a plate elongated in the right-left direction, and bent portions 222 formed at the front end and rear end of the base portion 221.

The base portion 221, the lower face of which is in contact with the inner peripheral surface of the fixing belt 110, receives heat from the halogen lamp 210 and transfers the received heat through the fixing belt 110 to toner on the sheet S. One bent portion 222 extends upwardly from the front end of the base portion 221 and the other bent portion 222 extends upwardly from the rear end of the base portion 221.

Figures 4A, 4B:
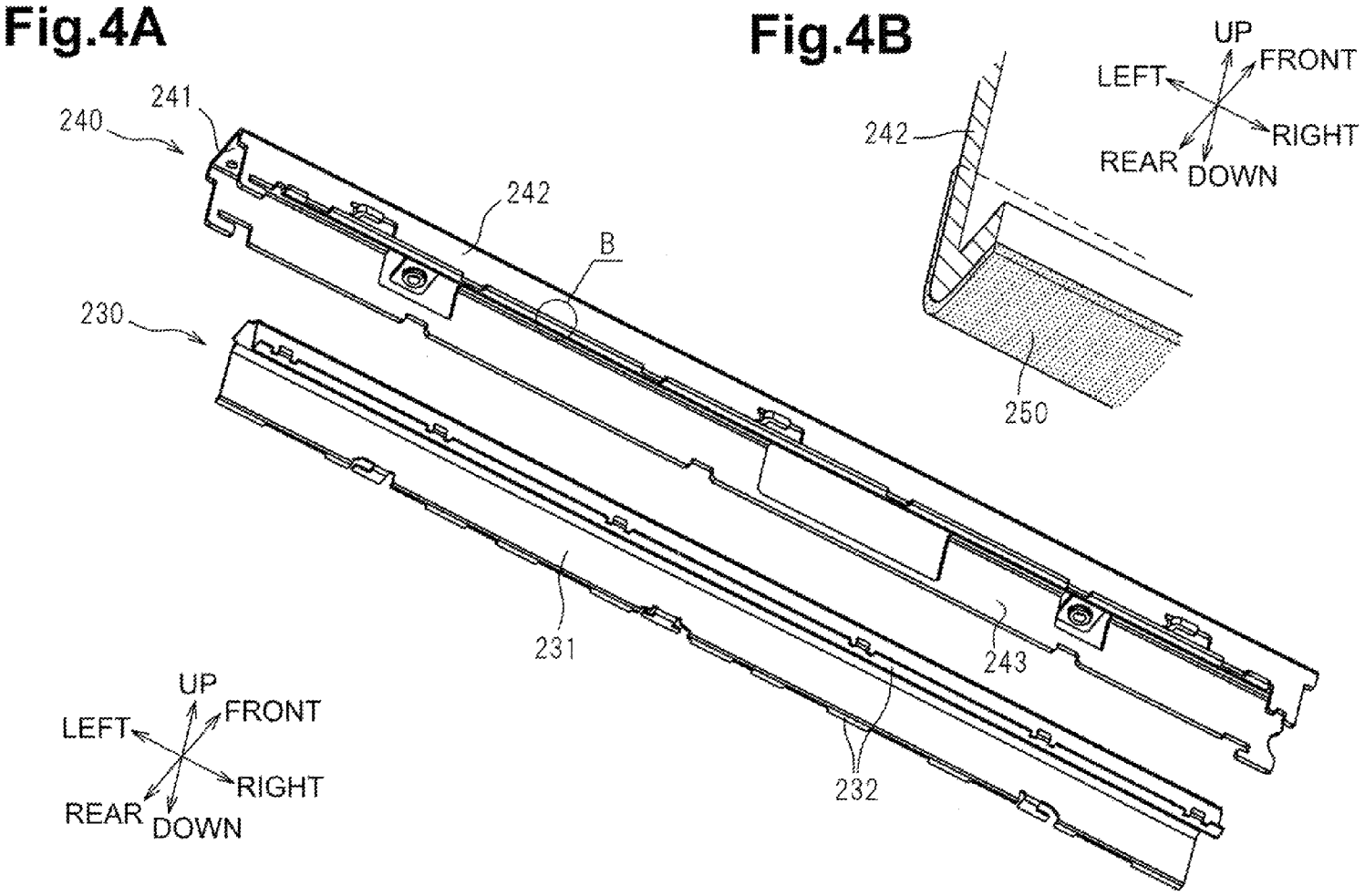
FIG. 4A is a perspective view of a reflective member and a stay of the fixing device, according to the first embodiment of the invention.
FIG. 4B is an enlarged view of portion B of the stay in FIG. 4A.

As shown in FIGS. 2 and 4A, the reflective member 230 reflects radiant heat (radiant heat emitted from the halogen lamp 210 mainly in the front-rear direction and in the upward direction) toward the nip plate 220 (particularly, the upper face of the base portion 221). The reflective member 230 is disposed with a prescribed spacing from the halogen lamp 210 so as to cover the halogen lamp 210.

Since this reflective member 230 collects the radiant heat from the halogen lamp 210 on the nip plate 220, the radiant heat from the halogen lamp 210 can be efficiently used, enabling the nip plate 220 and the fixing belt 110 to be quickly heated.

Specifically, the reflective member 230 is formed by bending in a substantially U-shape an aluminum plate, or a plate made of other metallic material, which reflects infrared rays and far infrared rays with high reflectance and has higher thermal conductivity than the stay 240. More specifically, the reflective member 230 has a reflective portion 231 in a curved shape, which is a substantially U-shape in cross-sectional view, and flange portions 232 that are disposed facing the nip plate 220 and extend from both ends of the reflective portion 231 in directions away from the halogen lamp 210; one of the flange portions 232 extends to the front and the other extends to the rear. The reflective member 230 is thinner than the stay 240.

The stay 240 supports, from the opposite side from the pressure roller 120, both ends of the nip plate 220, one end extending to the front and the other end extending to the rear.

When a force is exerted from the pressure roller 120 to the nip plate 220, the stay 240 receives the force. The stay 240 is formed by bending a steel plate, or a metal plate, having relatively high stiffness in a substantially U-shape in cross-sectional view along the reflective member 230 (particularly, the reflective portion 231), so as to define an opening which is open toward the nip plate 220.

More specifically, the stay 240 includes an upper wall 241 disposed above the halogen lamp 210, a front wall 242 (a first receiving portion) extending downwardly from the front end of the upper wall 241, and a rear wall 243 (a second receiving portion) extending downwardly from the rear end of the upper wall 241. The front wall 242 and the rear wall 243 receive a force exerted from the pressure roller 120 to the nip plate 220.

The front wall 242 is disposed upstream of the halogen lamp 210 in the conveying direction of the sheet S. The lower end of the front wall 242 sandwiches, in cooperation with the nip plate, the flange portion 232 disposed on the front side of the reflective member 230, and also supports the front end of the nip plate 220 (the end of the bent portion 222 on the front side) from above.

The rear wall 243 is disposed downstream of the halogen lamp 210 in the conveying direction of the sheet S. The lower end of the rear wall 243 sandwiches, in cooperation with the nip plate 220, the flange portion 232 disposed on the rear side of the reflective member 230, and also supports the rear end of the nip plate 220 (the rear end of the base portion 221) from above.

In this embodiment, the lower end of the front wall 242 is disposed upstream of the nip region N in the conveying direction of the sheet S, and the lower end of the rear wall 243 is disposed downstream of the nip region N in the conveying direction of the sheet S.

Figure 5:
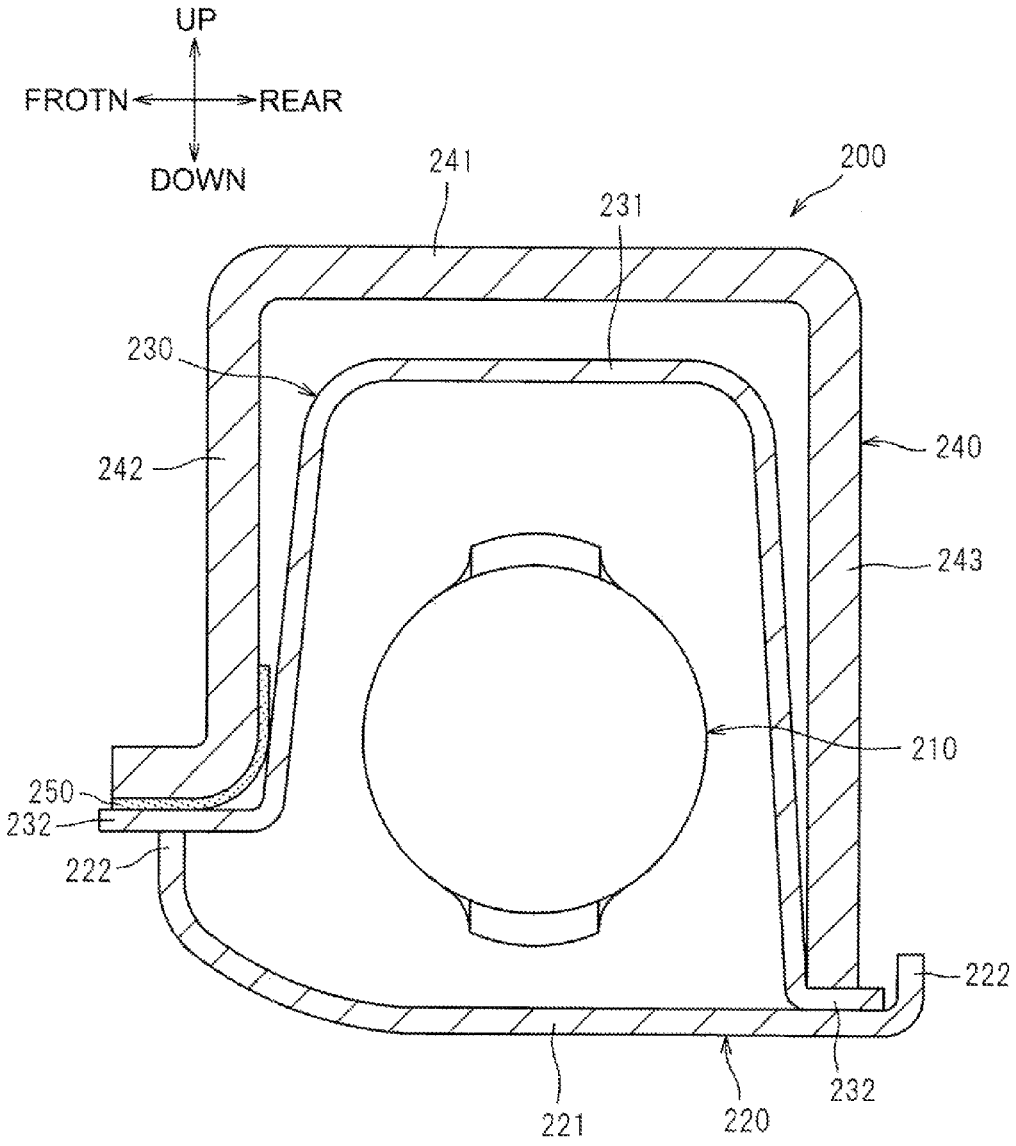
FIG. 5 is an enlarged cross-sectional view of a halogen lamp, the nip plate, the reflective member, the stay, and a heat insulator of the fixing device, according to the first embodiment of the invention.

As shown in FIG. 5, the heat insulator 250 is provided between the nip plate 220 and the front wall 242 of the stay 240, specifically between the front wall 242 and the flange portion 232 disposed on the front side of the reflective member 230.

The heat insulator 250 is a resin tape which may be a foamed resin tape. A polyimide tape, which is a resin tape superior in heat resistance, can be used as an example of the heat insulator 250. The heat insulator 250 is attached at the lower end of the front wall 242, from the left end to the right end, as shown in FIG. 4B. The heat insulator 250 entirely covers the lower face, which is close to the reflective member 230, of the front wall 242.

Thus, the heat insulator 250 is disposed so as to be sandwiched between the front wall 242 and the flange portion 232 on the front side as shown in FIG. 5, preventing the front wall 242 and the flange portion 232 on the front side from being brought into contact with each other.

The physical properties of the material of the heat insulator 250 and its thickness are preferably enough to suppress heat transfer between the front wall 242 and the flange portion 232 on the front side.

The heat insulator 250 is not disposed between the rear wall 243 of the stay 240 and the nip plate 220; the rear wall 243 is in contact with the flange portion 232 on the rear side of the reflective member 230. That is, the heat insulator 250 is disposed only between the front wall 242 of the stay 240 and the nip plate 220, and is not disposed between the rear wall 243 of the stay 240 and the nip plate 220.

The fixing device 100, structured as described above according to the first embodiment, has the following advantages. When the halogen lamp 210 is turned on, the nip plate 220 receives radiant heat from the halogen lamp 210 and starts to be heated.

The reflective member 230, which is in contact with the nip plate 220, has high thermal conductivity and small thermal capacity attributable to the thin thickness of the reflective member 230, so the reflective member 230 is easily heated together with the nip plate 220. However, the stay 240 has lower thermal conductivity than the nip plate 220 and the reflective member 230, so the stay 240 is not easily heated. Since, in this embodiment, the heat insulator 250 is provided between the nip plate 220 and the front wall 242 of the stay 240, heat of the nip plate 220 is made less likely to be transferred to the stay 240. Thus, the nip plate 220 can be quickly heated. Unlike this embodiment, in the case where the heat of the nip plate 220 is easily transferred to the stay 240 and the stay 240 takes heat from the nip plate 220, the heating efficiency (temperature rising rate) of the nip plate 220 will be lowered.

Even if the sheet S and fixing belt 110 take heat from the nip plate 220 when they enter the nip region N, the front wall 242 does not take heat from the nip plate 220. This is because the heat insulator 250 is disposed between the nip plate 220 and the front wall 242, which is disposed upstream of the nip region N in the conveying direction. Accordingly, the temperature of the nip plate 220 is less likely to decrease.

When the halogen lamp 210 is turned off, the heat of the nip plate 220 is easily transferred to the rear wall 243. This is because the heat insulator 250 is not provided between the rear wall 243 and the nip plate 220. Thus, heat of the nip plate 220 is allowed to escape to the stay 240 during the cooling of the nip plate 220, so the nip plate 220 can be quickly cooled.

So far, the first embodiment of the invention has been described, but the invention is not limited to the embodiment. The specific structures can be appropriately changed without departing from the intended scope of the invention.

Figure 6:
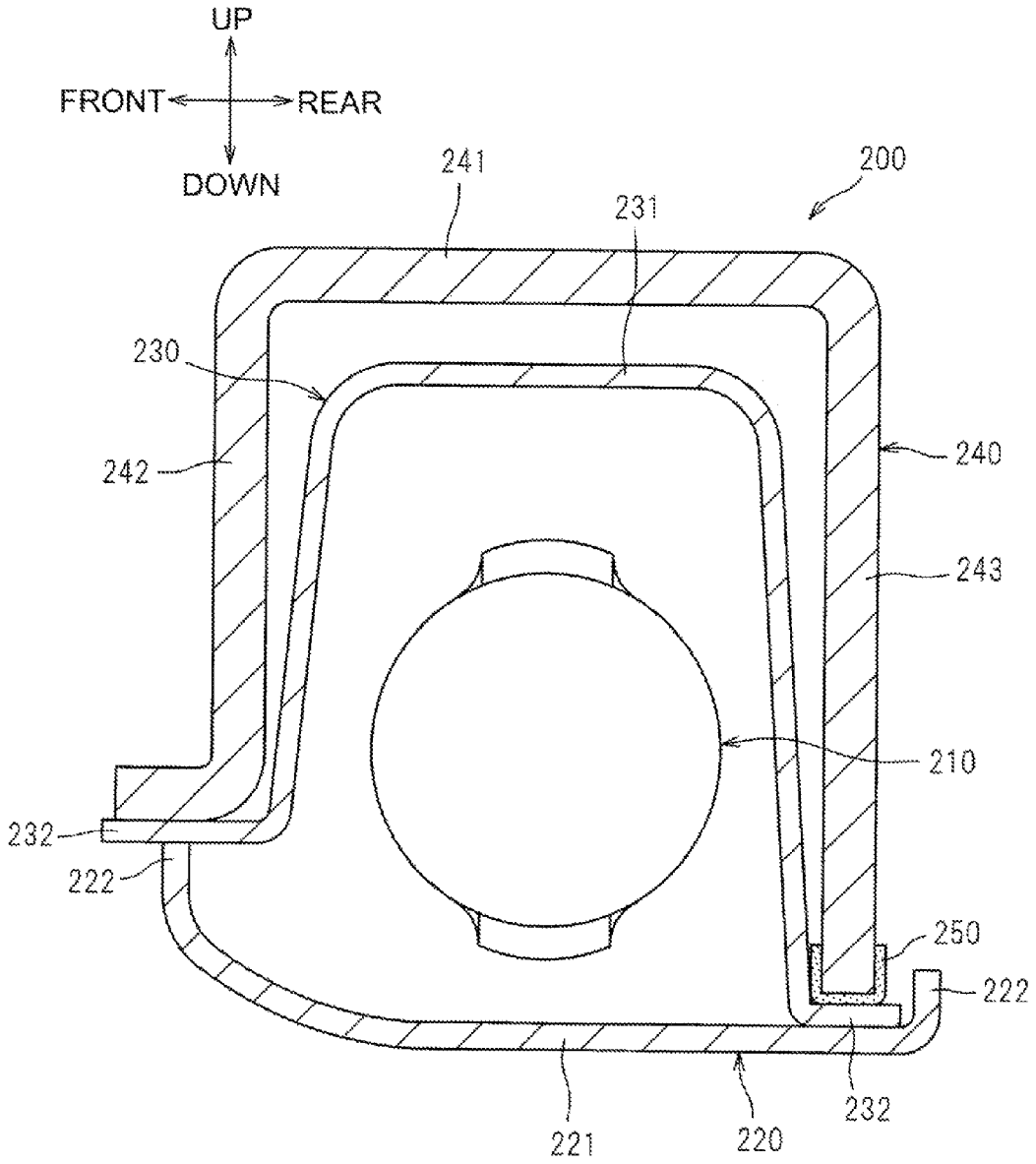
FIG. 6 is an enlarged cross-sectional view of a halogen lamp, a nip palate, a reflective member, a stay, and a heat insulator of a fixing device, according to a first modification of the first embodiment of the invention.

Although, in the first embodiment described above, the heat insulator 250 is provided between the front wall 242 of the stay 240 and the nip plate 220, but not provided between the rear wall 243 and the nip plate 220, the invention is not limited to this structure. For example, as shown in FIG. 6, a heat insulator 250 may be provided between the rear wall 243 and the nip plate 220 but may not be provided between the front wall 242 and the nip plate 220.

Specifically, the heat insulator 250 is attached to the lower end of the rear wall 243 so as to cover the lower face of the rear wall 243. Thus, the heat insulator 250 is disposed between the rear wall 243 and the flange portion 232 on the rear side of the reflective member 230.

Even in this structure, as in the first embodiment described above, heat of the nip plate 220 is made less likely to be transferred to the stay 240 during the heating of the nip plate 220, and heat of the nip plate 220 is allowed to escape to the stay 240 during the cooling of the nip plate 220 (when the halogen lamp 210 is turned off).

Although, in the embodiments described above, the heat insulator 250 is provided between the nip plate 220 and only one of the front wall 242 and the rear wall 243 of the stay 240, the invention is not limited to this structure. For example, heat insulators having different heat insulating effects may be provided between the front wall 242 and the nip plate 220 and between the rear wall 243 and the nip plate 220.

Figure 7:
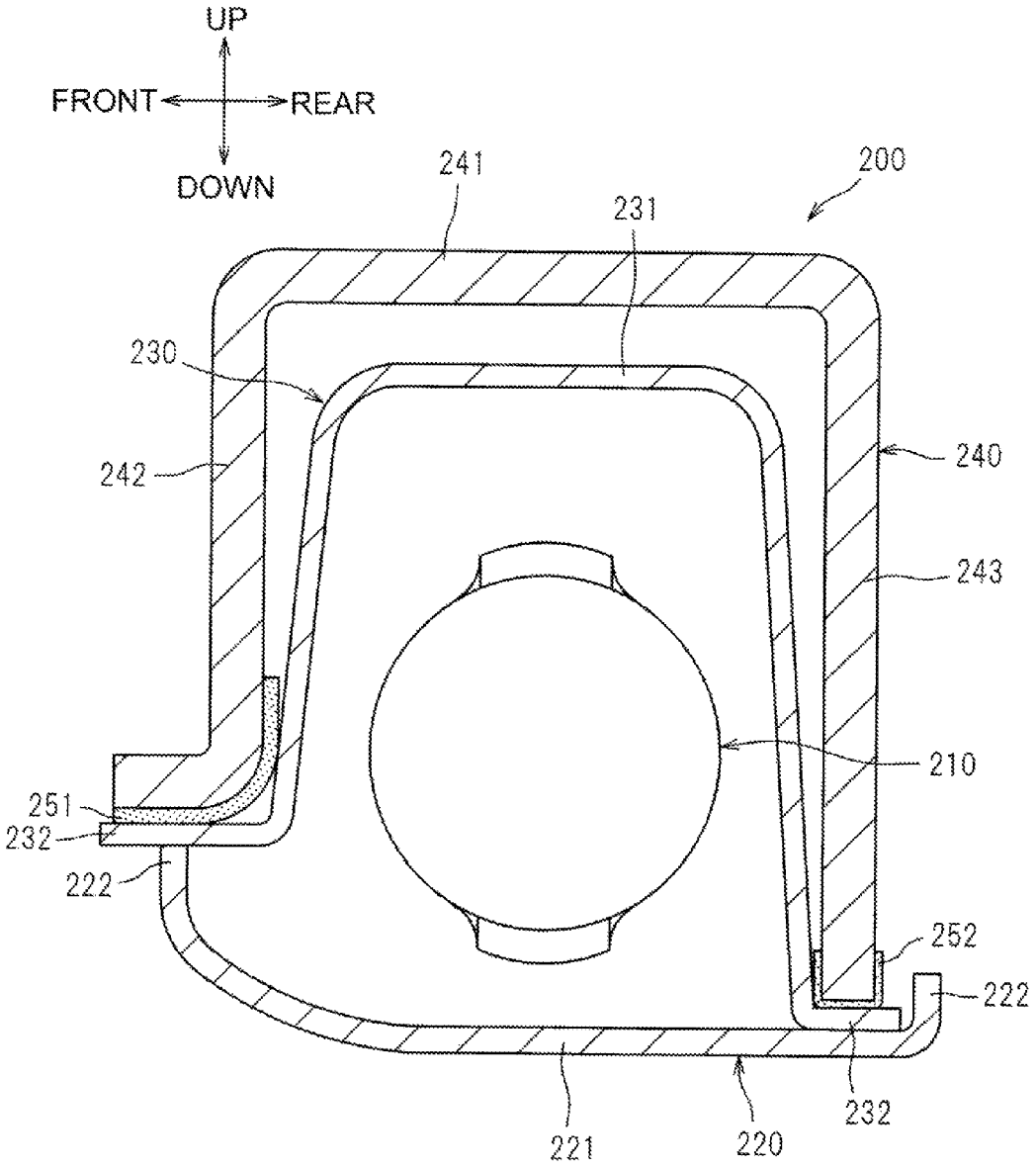
FIG. 7 is an enlarged cross-sectional view of a halogen lamp, a nip palate, a reflective member, a stay, and a heat insulator of a fixing device, according to a second modification of the first embodiment of the invention.

Specifically, as shown in FIG. 7, a first heat insulator 251 is provided between the front wall 242 and the nip plate 220 and a second heat insulator 252 is provided between the rear wall 243 and the nip plate 220.

The first heat insulator 251 is attached to the lower end of the front wall 242 so as to cover the lower face of the front wall 242. The first heat insulator 251 is disposed between the front wall 242 and the flange portion 232 on the front side of the reflective member 230.

The second heat insulator 252 is attached to the lower end of the rear wall 243 so as to cover the lower face of the rear wall 243. The second heat insulator 252 is disposed between the rear wall 243 and the flange portion 232 on the rear side of the reflective member 230. Although the second heat insulator 252 is made of the same material as the first heat insulator 251, the second heat insulator 252 is thinner than the first heat insulator 251. As compared with the first heat insulator 251, the second heat insulator 252 allows more heat transfer between the rear wall 243 and the flange portion 232 on the rear side.

In this structure, heat of the nip plate 220 is made less likely to be transferred to the rear wall 243 and the front wall 242 of the stay 240 during the heating of the nip plate 220. However, heat of the nip plate 220 is allowed to escape to the rear wall 243 of the stay 240 during the cooling of the nip plate 220.

A first heat insulator and a second heat insulator may be made of materials having different heat insulating performances and may have the same thickness. For example, a first heat insulator may be made of a material having a physical property unlikely to transfer heat, and a second heat insulator may be made of a material having a physical property more likely to transfer heat than the material of the first heat insulator. When the first heat insulator and the second heat insulator are made in this way, they have different heat insulating effects.

A first heat insulator and a second heat insulator may be made of materials having the same heat insulating performance and may have the same thickness. An exposed area of a second heat insulator attached to the lower face of the front wall 242 may be larger than an exposed area of a first heat insulator attached to the lower face of the rear wall 243. In this structure, the first heat insulator and second heat insulator have different heat insulating effects.

Although, in the first embodiment described above, the heat insulator 250 is disposed between the front wall 242 of the stay 240 and the flange portion 232 on the front side of the reflective member 230, the invention is not limited to this structure. For example, a heat insulator may be disposed between the nip plate 220 and the flange portion 232 on the front side. Alternatively, a heat insulator may be disposed both between the front wall 242 and the flange portion 232 on the front side and between the nip plate 220 and the flange portion 232 on the front side.

Figure 8:
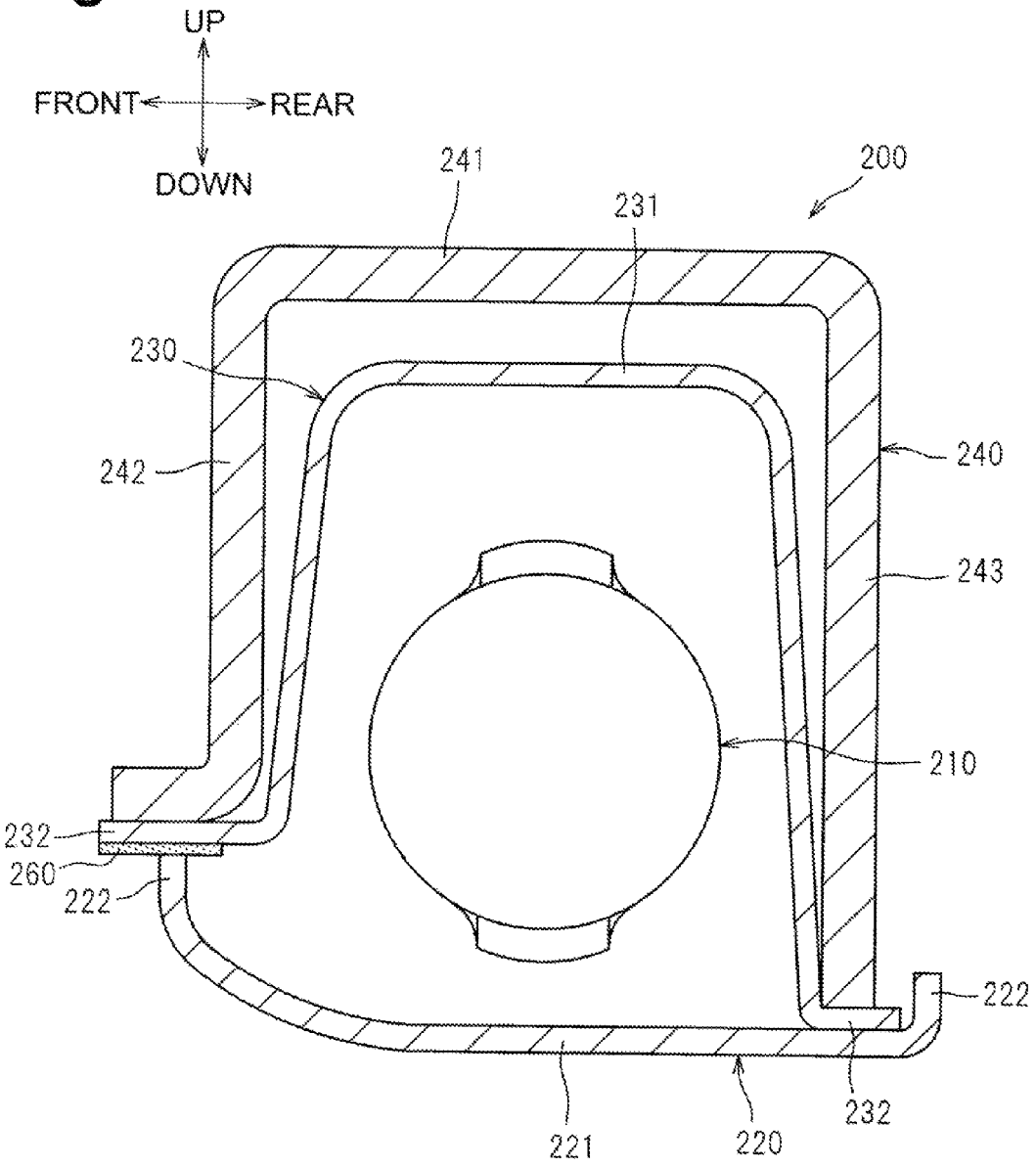
FIG. 8 is an enlarged cross-sectional view of a halogen lamp, a nip palate, a reflective member, a stay, and a heat insulator of a fixing device, according to a third modification of the first embodiment of the invention.

A specific example in which a heat insulator is disposed between the nip plate 220 and the flange portion 232 on the front side will be described with reference to FIG. 8. A heat insulator 260 is attached to the reflective member 230 so as to cover the lower face of the flange portion 232 on the front side. Thus, heat of the nip plate 220 is made less likely to be transferred to the flange portion 232. Heat of the nip plate 220 is thereby made less likely to be transferred to the front wall 242 of the stay 240. The front wall 242 is in contact with the flange portion 232.

Figure 9:
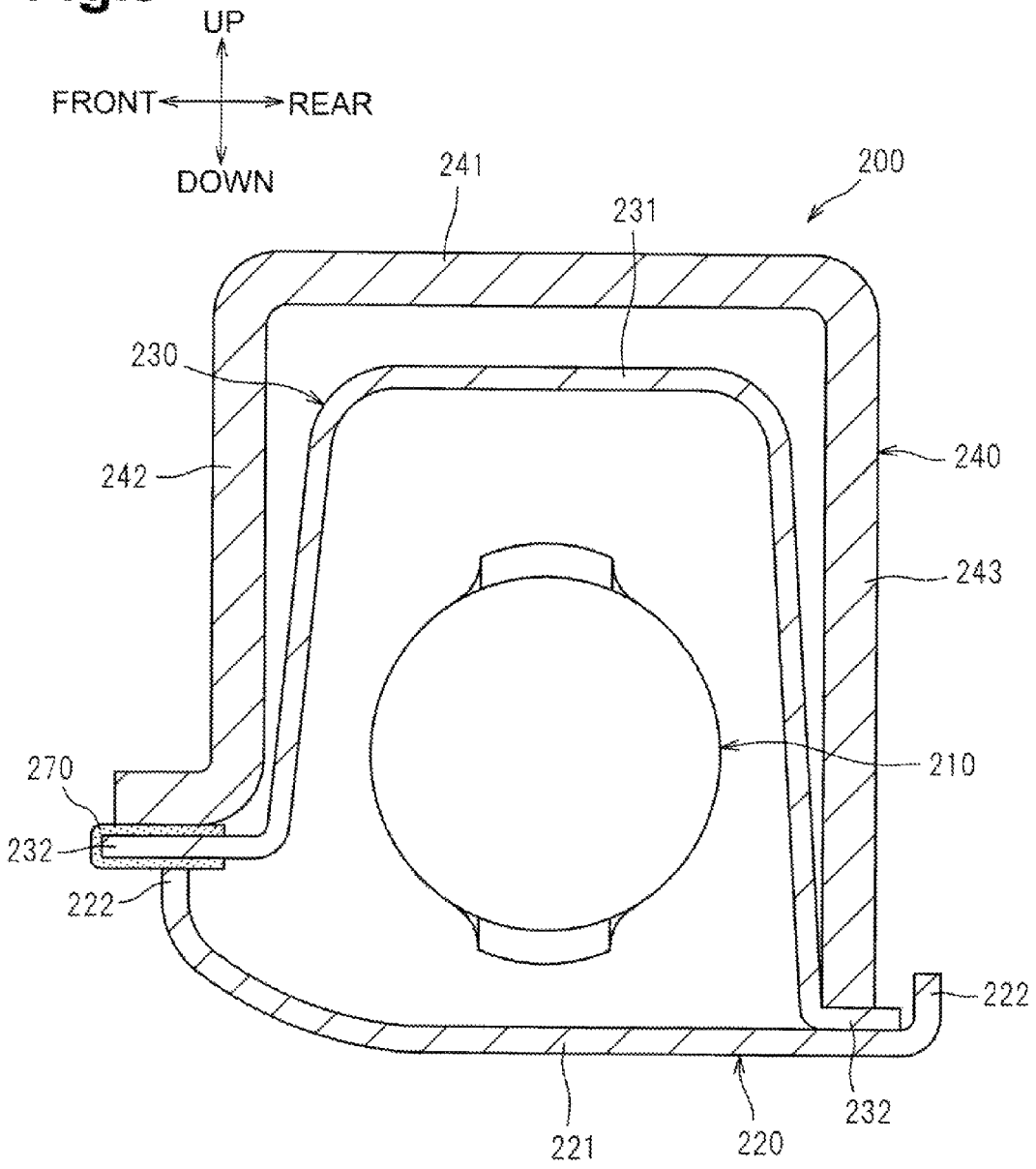
FIG. 9 is an enlarged cross-sectional view of a halogen lamp, a nip palate, a reflective member, a stay, and a heat insulator of a fixing device, according to a fourth modification of the first embodiment of the invention.

Next, an example in which heat insulators are disposed both between the front wall 242 and the flange portion 232 on the front side and between the nip plate 220 and the flange portion 232 on the front side will be described with reference to FIG. 9. A heat insulator 270 is attached so as to be wrapped around the end of the flange portion 232 on the front side and cover both the lower face and upper face of the flange portion 232. Thus, heat of the nip plate 220 is made less likely to be transferred to the flange portion 232 on the front side, and heat of the flange portion 232 is also made less likely to be transferred to the front wall 242. As a result, heat of the nip plate 220 is made further less likely to be transferred to the front wall 242.

Although, in the first embodiment described above, the tape-like heat insulator 250 is attached to the lower end of the front wall 242 of the stay 240 to place the heat insulator 250 between the front wall 242 and the flange portion 232 at the front end of the reflective member 230, the invention is not limited to this structure. For example, a heat-insulative coating may be applied to the lower end of the front wall 242, or a sheet-like heat insulator may be secured to the lower end of the front wall 242 with an adhesive or a double-faced adhesive tape.

Although, in the first embodiment described above, the heat insulator 250 is made of resin, the invention is not limited to this. For example, a heat insulator may be made of a ceramic material or any of various fibrous materials such as glass cloth, and may be a glass cloth tape.

Although, in the first embodiment described above, the halogen lamp 210 is taken as an example of a heat generating member, the invention is not limited to this. The heat generating member may be, for example, a carbon heater.

Although, in the first embodiment described above, the nip plate 220 having a plate-shape is taken as an example of a nip plate, the invention is not limited to this. For example, a relatively thick member, which is not plate-shaped, may be used.

Although, in the first embodiment described above, the pressure roller 140 is taken as an example of a rotating member, the invention is not limited to this. The rotating member may be, for example, a belt-shaped pressurizing member.

Although, in the first embodiment described above, the sheet S such as plain paper and a postcard is taken as an example of the recording sheet, the invention is not limited to this. The recording sheet may be, for example, an overhead projector (OHP) sheet.

<Fixing Device in Second Embodiment>

Figure 10:
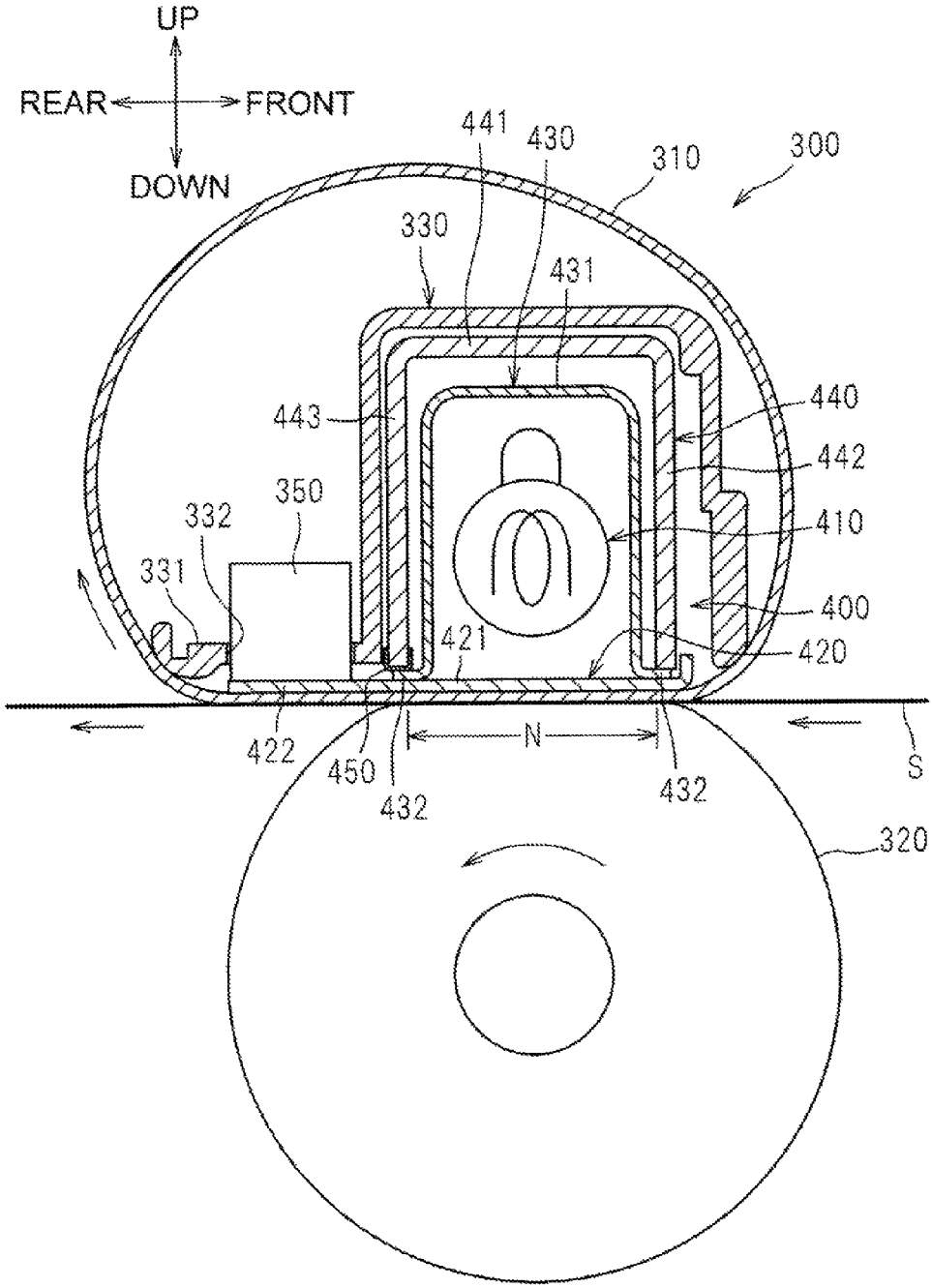
FIG. 10 is a cross-sectional view of a fixing device according to a second embodiment of the invention.

A fixing device 300 used for a laser printer, according to a second embodiment of the invention will now be described. The fixing device 300 may be used, in place of the fixing device 100, for the laser printer 1 shown in FIG. 1. As shown in FIG. 10, the fixing device 300 mainly includes a tubular fixing belt 310, a heating unit 400 that is disposed in an inner space defined by the fixing belt 310 and heats the fixing belt 310, and a rotating member, e.g., a pressure roller 320, temperature sensors 350, and a cover member 330. The fixing belt 310 is interposed between the pressure roller 320 and the heating unit 400.

The fixing belt 310, which is heated by the heating unit 400 described later, is a belt having heat resistance and flexibility. The rotation of the fixing belt 310 is guided by a guide member (not shown).

The pressure roller 320, which can be elastically deformed, is disposed below the fixing belt 310 and the heating unit 400. When the pressure roller 320 is elastically deformed and nips the fixing belt 310 in cooperation with the heating unit 400 (particularly, a nip plate 420), a nip region N is formed. In this embodiment, the heating unit 400 and pressure roller 320 are mutually brought into pressure contact while one of them is urged toward the other.

When a driving force is transmitted from a motor (not shown) provided in the housing 2 to the pressure roller 320, its rotation is driven. Then, the fixing belt 310 is rotated by a frictional force exerted between the pressure roller 320 and the fixing belt 310 (or the sheet S). Thus, while the sheet S, to which the toner image has been transferred, is conveyed from front to rear between the pressure roller 320 and the heated fixing belt 110, the toner image (toner) is thermally fixed to the sheet S.

The heating unit 400, which heats toner on the sheet S through the fixing belt 310, includes a heat generating member, e.g., a halogen lamp 410, the nip plate 420, a reflective member 430, and a stay 440.

The halogen lamp 410 is a heater that generates radiant heat and heats the nip plate 420 and the fixing belt 410 thereby to heat the toner on the sheet S. The halogen lamp 410 is disposed in the inner space defined by the fixing belt 410 with prescribed spacing from the fixing belt 410 and from the inner face of the nip plate 420.

The nip plate 420 is a plate-shaped member made of metal and receives radiant heat from the halogen lamp 410. The nip plate 420 is disposed in the inner space defined by the fixing belt 310 so that the inner peripheral surface of the tubular fixing belt 310 makes sliding contact with the surface of the nip plate 420. In this embodiment, the nip plate 420 is formed by machining an aluminum plate, or a plate made of other material, having higher thermal conductivity than the steel stay 440 described later.

Figure 11:
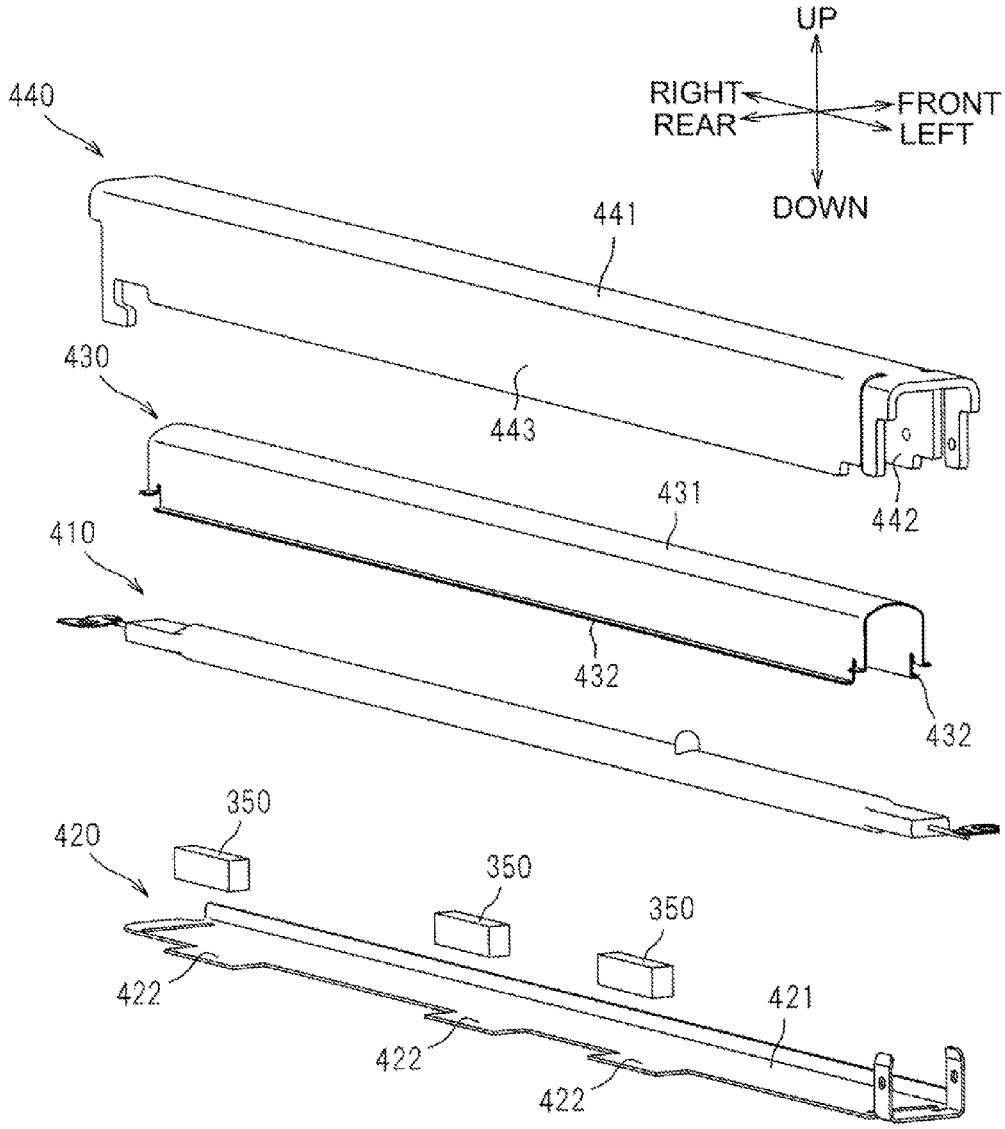
FIG. 11 is an exploded perspective view of a heating unit and temperature sensors of the fixing device, according to the second embodiment of the invention.

As shown in FIG. 11, the nip plate 420 includes a base portion 421, which is formed like a plate elongated in the right-left direction, and three protruding portions 422 formed at the rear end of the base portion 421.

The base portion 421, the lower face of which is in contact with the inner peripheral surface of the fixing belt 310, receives heat from the halogen lamp 410 and transfers the received heat through the fixing belt 110 to toner on the sheet S.

Two protruding portions 422 are provided at a central portion of the rear end of the base portion 421, and one protruding portion 422 is provided at a right end portion of the rear end of the base portion 221. More specifically, as shown in FIG. 10, the protruding portions 422 extend rearwardly beyond a rear wall 443 of the stay 440 and a flange portion 432 of the reflective member 430.

As shown in FIGS. 10 and 11, the reflective member 430 reflects radiant heat (radiant heat emitted from the halogen lamp 410 mainly in the front-rear direction and in the upward direction) toward the nip plate 420 (particularly, the upper face of the base portion 421). The reflective member 430 is disposed with a prescribed spacing from the halogen lamp 410 so as to cover the halogen lamp 410.

Since this reflective member 430 collects the radiant heat from the halogen lamp 410 on the nip plate 420, the radiant heat from the halogen lamp 410 can be efficiently used, enabling the nip plate 420 and the fixing belt 310 to be quickly heated.

Specifically, the reflective member 430 is formed by bending in a substantially U-shape an aluminum plate, or a plate made of other metallic material, which reflects infrared rays and far infrared rays with high reflectance and has higher thermal conductivity than the stay 440. More specifically, the reflective member 430 has a reflective portion 431 in a curved shape, which is a substantially U-shape in cross-sectional view, and flange portions 432 that are disposed facing the nip plate 420 and extend from both ends of the reflective portion 431 in directions away from the halogen lamp 410; one of the flange portions 432 extends to the front and the other extends to the rear. The reflective member 430 is thinner than the stay 440.

The stay 440 supports, from the opposite side from the pressure roller 320, both ends of the nip plate 420, one end extending to the front and the other end extending to the rear. When a force is exerted from the pressure roller 320 to the nip plate 420, the stay 440 receives the force. The stay 440 is formed by bending a steel plate, or a metal plate, having relatively high stiffness in a substantially U-shape in cross-sectional view along the reflective member 430 (particularly, the reflective portion 431), so as to define an opening which is open toward the nip plate 420.

More specifically, the stay 440 includes an upper wall 441 disposed above the halogen lamp 410, a front wall 442 (a first receiving portion) extending downwardly from the front end of the upper wall 441, and a rear wall 443 (a second receiving portion) extending downwardly from the rear end of the upper wall 441. The front wall 442 and the rear wall 443 receive a force exerted from the pressure roller 320 to the nip plate 420.

As shown in FIG. 10, the front wall 442 is disposed upstream of (on one side of) the halogen lamp 410 in the conveying direction of the sheet S. The lower end of the front wall 442 sandwiches, in cooperation with the nip plate, the flange portion 432 disposed on the front side of the reflective member 430, and also supports the front end of the nip plate 420 (the front end of the base portion 421) from above.

The rear wall 443 is disposed downstream of (on the other side of) the halogen lamp 410 in the conveying direction of the sheet S. The lower end of the rear wall 443 sandwiches, in cooperation with the nip plate 420, the flange portion 432 disposed at the rear end of the reflective member 430, and also supports the rear end of the nip plate 420 (the rear end of the base portion 421) from above.

In this embodiment, the lower end of the front wall 442 is disposed upstream of the nip region N in the conveying direction of the sheet S, and the lower end of the rear wall 443 is disposed downstream of the nip region N in the conveying direction of the sheet S.

Figure 12:
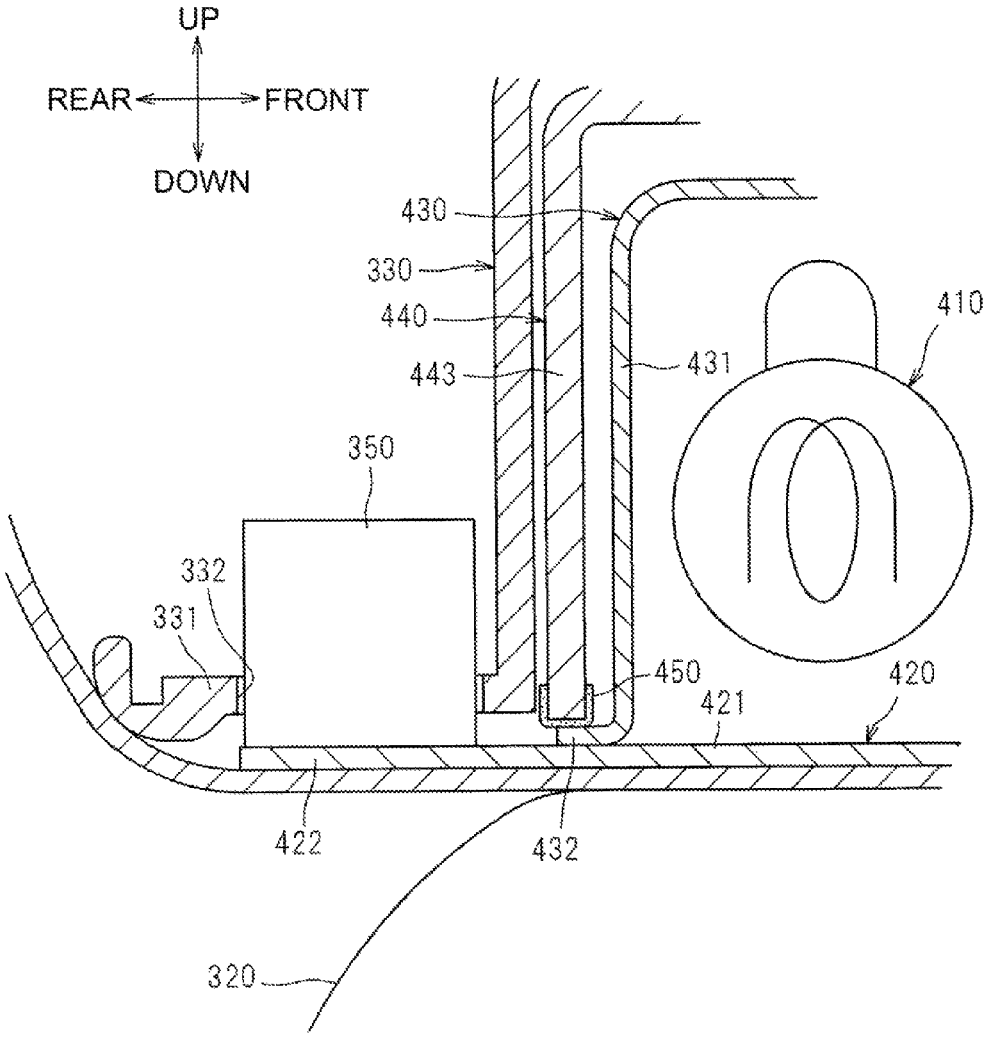
FIG. 12 is an enlarged cross-sectional view of a heat insulator and its vicinity of the fixing device, according to the second embodiment of the invention.

As shown in FIG. 12, the heat insulator 450 is provided between the nip plate 420 and the rear wall 443 of the stay 440, specifically between the rear wall 243 and the flange portion 432 on the rear side of the reflective member 230.

The heat insulator 450 is a resin tape which may be a foamed resin tape. A polyimide tape, which is a resin tape superior in heat resistance, can be used as an example of the heat insulator 450. The heat insulator 450 is attached at the lower end of the rear wall 443, from the left end to the right end. The heat insulator 450 covers the lower face of the rear wall 443. Thus, the heat insulator 450 is sandwiched between the rear wall 443 and the flange portion 432 on the rear side, preventing the rear wall 443 and the flange portion 432 from being brought into contact with each other.

The physical properties of the material of the heat insulator 450 and its thickness are preferably enough to suppress heat transfer between the rear wall 443 and the flange portion 432 on the rear side.

As shown in FIG. 10, the heat insulator 450 is not disposed between the nip plate 420 and the front wall 442 of the stay 440.

The temperature sensors 350, each of which is a known sensor such as a thermostat or a thermistor, are disposed on the opposite side of the rear wall 443 of the stay 440 from the halogen lamp 410 and senses the temperature of the nip plate 420.

Specifically, as shown in FIG. 11, the temperature sensor 350 is provided for each of the protruding portions 422 of the nip plate 420 and is disposed in contact with the upper face of the corresponding protruding portion 422. The temperature sensor 350 outputs the sensing result to a control unit (not shown) that controls the fixing device 300 (particularly, the halogen lamp 410).

As shown in FIG. 10, the cover member 330 is disposed in the inner space of the fixing belt 310 to cover the heating unit 200. The cover member 330 has a substantially U-shape in a cross-sectional view and includes a retainer 331 extending rearwardly in the conveying direction of the sheet S from the lower end of the rear wall 443.

Through-holes 332 are formed vertically through the retainer 331 at positions overlapping the respective protruding portions 422 of the nip plate 420. The temperature sensors 350 disposed on the protruding portions 422 are fitted in the holes 332, respectively so as not to be displaced in the front-rear direction and in the right-left direction.

The fixing device 300, structured as described above according to the second embodiment, has the following advantages. When the halogen lamp 410 is turned on and the base portion 421 of the nip plate 420 is heated by the halogen lamp 410, the base portion 421 transfers heat to the protruding portions 422, thereby heating the protruding portions 422.

Heat of the nip plate 420 is unlikely to be transferred to the rear wall 443 of the stay 440 because the heat insulator 450 is provided between the nip plate 420 and the rear wall 443 of the stay 440. The stay 440 supports, through the reflective member 430, the rear end (located closer to the halogen lamp 410 than the protruding portions 422) of the base portion 421. Heat is transferred from the base portion 421 to the protruding portions 422 without escaping to the stay 440, and the base portion 421 and the protruding portions 422 are heated quickly to substantially the same temperature. Thus, the temperatures to be sensed by the temperature sensors 350 become substantially equal to the temperature of the nip region N. Accordingly, responsiveness of the temperature sensors 350 can be improved.

The reflective member 430, which has high thermal conductivity and small thermal capacity, is quickly heated to substantially the same temperature as that of the nip plate 420. Thus, the reflective member 430 is unlikely to take heat from the nip plate 420.

The heat insulator 250 is not provided between the front wall 442 of the stay 440 and the nip plate 420. Thus, when the halogen lamp 410 is turned off, the nip plate 420 is quickly cooled while heat escapes from the nip plate 420 to the front wall 442.

The second embodiment of the invention has been described, but the invention is not limited to the embodiment. The specific structures can be appropriately changed without departing from the intended scope of the invention.

Although, in the second embodiment described above, the heat insulator 450 is disposed between the rear wall 443 of the stay 440 and the flange portion 432 on the rear side of the reflective member 430, the invention is not limited to this structure. For example, a heat insulator may be disposed between the nip plate 420 and the flange portion 432 on the rear side. Alternatively, a heat insulator may be disposed both between the rear wall 443 and the flange portion 432 on the rear side and between the nip plate 420 and the flange portion 432 on the rear side.

Figure 13:
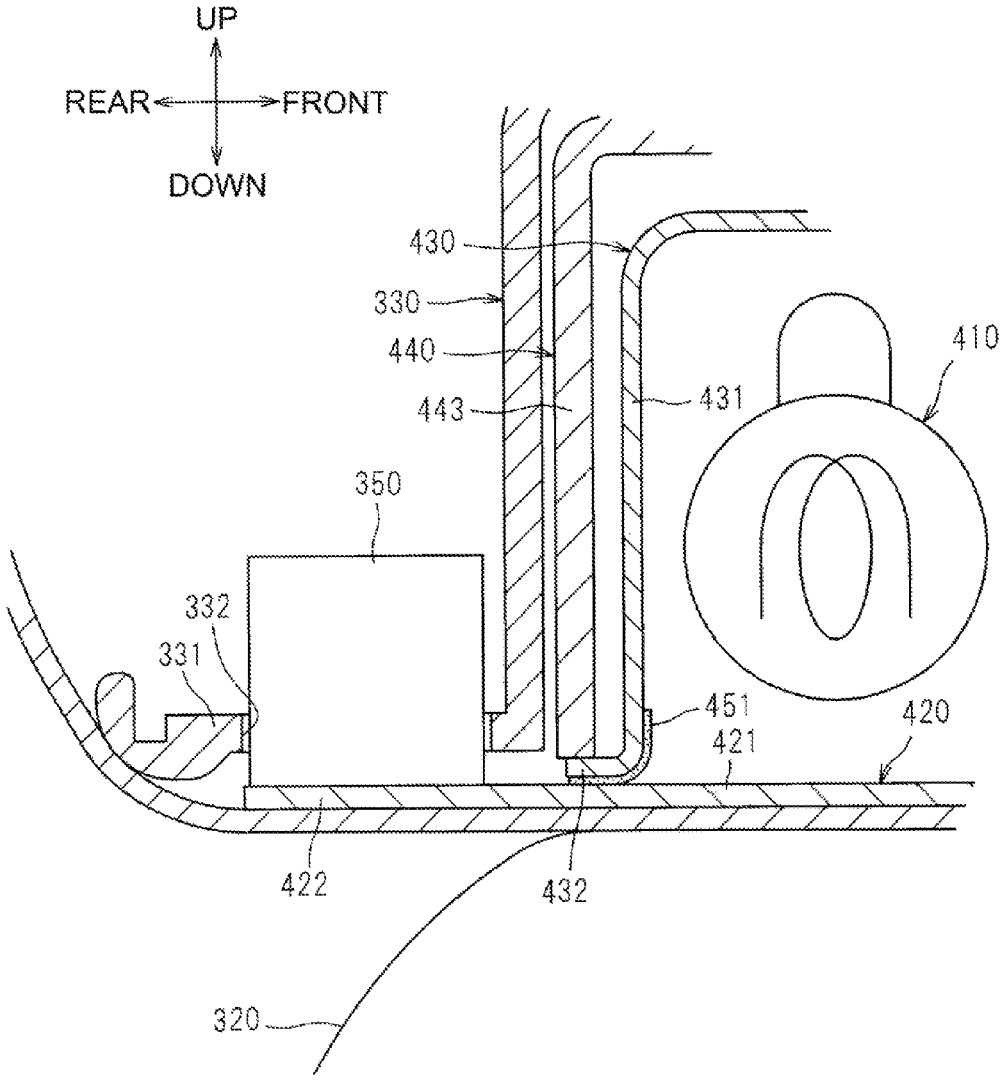
FIG. 13 is an enlarged cross-sectional view of a heat insulator and its vicinity of a fixing device, according to a first modification of the second embodiment of the invention.

A specific example in which a heat insulator is disposed between the nip plate 420 and the flange portion 432 on the rear side will be described with reference to FIG. 13. A heat insulator 461 is attached to the reflective member 430 so as to cover the lower face of the flange portion 432 on the rear side. The heat insulator 451, which prevents the flange portion 432 on the rear side from contacting the nip plate 420, suppresses heat transfer from the nip plate 420 to the stay 440 through the flange portion 432.

Thus, the base portion 421 of the nip plate 420 and the protruding portions 422 are quickly heated, and responsiveness of the temperature sensors 350 can be improved as in the second embodiment described above.

Figure 14:
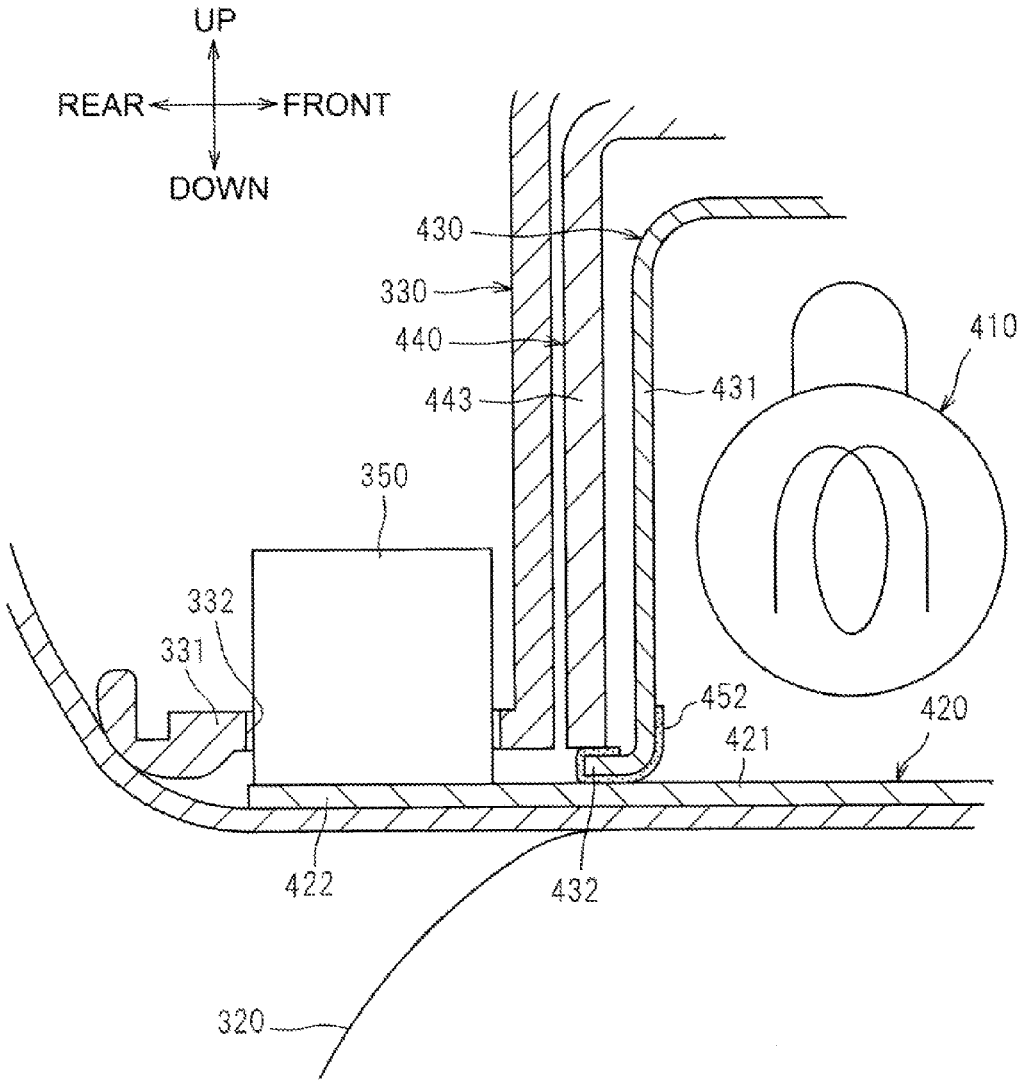
FIG. 14 is an enlarged cross-sectional view of a heat insulator and its vicinity of a fixing device, according to a second modification of the second embodiment of the invention.

Next, an example in which heat insulators are disposed both between the rear wall 443 and the flange portion 432 on the rear side and between the nip plate 420 and the flange portion 432 on the rear side will be described with reference to FIG. 14. A heat insulator 452 is attached so as to be wrapped around the end of the flange portion 432 on the rear side and cover both the upper face and lower face of the flange portion 432. Thus, heat of the nip plate 420 is made less likely to be transferred to the stay 440 through the flange portion 432 on the rear side.

Thus, the base portion 421 of the nip plate 420 and the protruding portions 422 are quickly heated, and responsiveness of the temperature sensors 350 can be improved as in the second embodiment described above.

Although, in the second embodiment described above, the heat insulator 450 is provided only between the rear wall 443 of the stay 440 and the nip plate 420, the invention is not limited to this structure. For example, a heat insulator 450 may be provided between the front wall 442 of the stay 440 and the nip plate 420.

Although, in the second embodiment described above, the temperature sensors 350 are disposed on the opposite side of the rear wall 443 of the stay 440 from the halogen lamp 410, i.e., disposed downstream of the stay 440 in the conveying direction of the sheet S, the invention is not limited to this structure. For example, temperature sensors may be disposed on the opposite side of the front wall 442 of the stay 440 from the halogen lamp 410, i.e., disposed upstream of the stay 440 in the conveying direction of the sheet S so as to be in contact with the nip plate 420. A heat insulator may be provided between the front wall 442 and the nip plate 440. In this case, the front wall 442 serves as a second support portion and the rear wall 443 serves as a first support portion.

Although, in the second embodiment described above, the tape-like heat insulator 450 is attached to the lower end of the rear wall 443 of the stay 440 to place the heat insulator 450 between the rear wall 443 and the flange portion 432 of the reflective member 430, the invention is not limited to this structure. For example, a heat-insulative coating may be applied to the lower end of the rear wall 443, or a sheet-like heat insulator may be secured to the lower end of the rear wall 443 with an adhesive or a double-faced adhesive tape.

Although, in the second embodiment described above, the heat insulator 450 is made of resin, the invention is not limited to this. For example, a heat insulator may be made of a ceramic material or any of various fibrous materials such as glass cloth, and may be a glass cloth tape.

Although, in the second embodiment described above, the halogen lamp 410 is taken as an example of a heat generating member, the invention is not limited to this. The heat generating member may be, for example, a carbon heater.

Although, in the second embodiment described above, the pressure roller 340 is taken as an example of a rotating member, the invention is not limited to this. The rotating member may be, for example, a belt-shaped pressurizing member.

Although, in the second embodiment described above, the sheet S such as plain paper and a postcard is taken as an example of the recording sheet, the invention is not limited to this. The recording sheet may be, for example, an overhead projector (OHP) sheet.

Although, in the second embodiment described above, the nip plate 420 having a plate-shape is taken as an example of a nip plate, the invention is not limited to this. For example, a relatively thick member, which is not plate-shaped, may be used.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

The invention claimed is:

1. A fixing device configured to thermally fix a developing agent image to a recording sheet, the fixing device comprising:

a fixing belt having a tubular shape defining an inner space;

a heat generating member disposed in the inner space of the fixing belt and configured to generate heat;

a nip member made of metal and disposed in the inner space of the fixing belt such that an inner surface of the fixing belt is configured to make slide contact with the nip member;

a rotating member configured to rotate and disposed outside the inner space of the fixing belt such that the fixing belt is nipped in a nip region between the nip member and the rotating member;

a stay made of metal and disposed in the inner space of the fixing belt, the stay comprising a first receiving portion and a second receiving portion configured to receive a force exerted from the rotating member to the nip member; and a heat insulator made of a non-metallic material and disposed between the nip member and the first receiving portion of the stay and not disposed between the nip member and the second receiving portion of the stay.

2. The fixing device according to claim 1, wherein the heat insulator is only disposed between the nip member and the first receiving portion of the stay.

3. The fixing device according to claim 1, wherein no heat insulator is disposed between the nip member and the second receiving portion of the stay.

4. The fixing device according to claim 1, wherein the first receiving portion and the second receiving portion of the stay are located upstream and downstream of the nip region, respectively, in a conveying direction of the recording sheet.

5. The fixing device according to claim 1, further comprising a reflective member made of metal and configured to reflect the heat generated by the heat generating member, the reflective member comprising a first end portion and a second end portion, the first end portion and the heat insulator being disposed between the nip member and the first receiving portion of the stay, and the second end portion being in direct contact with the nip member and with the second receiving portion of the stay.

6. The fixing device according to claim 5, wherein the first receiving portion of the stay and the first end portion of the reflective member are separated from each other by the heat insulator sandwiched therebetween.

7. The fixing device according to claim 5, wherein the nip member and the first end portion of the reflective member are separated from each other by the heat insulator sandwiched therebetween.

8. The fixing device according to claim 5, wherein the first end portion of the reflective member comprises a flange portion extending in a direction away from the heat generating member to an end of the nip member, the flange portion and the heat insulator being disposed between the end of the nip member and the first receiving portion of the stay.

9. The fixing device according to claim 5, wherein the stay has lower thermal conductivity than the nip member and the reflective member.

10. The fixing device according to claim 1, wherein the heat insulator comprises a heat-resistant resin tape.

11. The fixing device according to claim 2, wherein the nip member has a curved surface extending from the nip region toward the heat insulator and is in contact with the inner surface of the fixing belt, the curved surface being configured to guide the recording sheet to the nip region.

12. A fixing device configured to thermally fix a developing agent image to a recording sheet, the fixing device comprising:

a fixing belt having a tubular shape defining an inner space;

a heat generating member disposed in the inner space of the fixing belt and configured to generate heat;

a nip member made of metal and disposed in the inner space of the fixing belt such that an inner surface of the fixing belt is configured to make slide contact with the nip member;

a rotating member configured to rotate and disposed outside the inner space of the fixing belt such that the fixing belt is nipped in a nip region between the nip member and the rotating member;

a stay made of metal and disposed in the inner space of the fixing belt, the stay comprising a first receiving portion and a second receiving portion configured to receive a force exerted from the rotating member to the nip member; and a single heat insulator made of a non-metallic material, the single heat insulator being disposed only between the nip member and the first receiving portion of the stay.

13. The fixing device according to claim 12, wherein the first receiving portion and the second receiving portion of the stay are located upstream and downstream of the nip region, respectively, in a conveying direction of the recording sheet.

14. The fixing device according to claim 12, further comprising a reflective member made of metal and configured to reflect the heat generated by the heat generating member, wherein the reflective member and the first receiving portion of the stay are separated from each other by the heat insulator sandwiched therebetween.

15. A fixing device configured to thermally fix a developing agent image to a recording sheet, the fixing device comprising:

a fixing belt having a tubular shape defining an inner space;

a heat generating member disposed in the inner space of the fixing belt and configured to generate heat;

a nip member made of metal and disposed in the inner space of the fixing belt such that an inner surface of the fixing belt is configured to make slide contact with the nip member;

a rotating member configured to rotate and disposed outside the inner space of the fixing belt such that the fixing belt is nipped in a nip region between the nip member and the rotating member;

a stay made of metal and disposed in the inner space of the fixing belt, the stay comprising a first receiving portion and a second receiving portion configured to receive a force exerted from the rotating member to the nip member;

a reflective member made of metal and configured to reflect the heat generated by the heat generating member, the reflecting member comprising a first end portion and a second end portion; and a heat insulator made of a non-metallic material, wherein the first end portion of the reflective member and the first receiving portion of the stay are separated from each other by the heat insulator sandwiched therebetween, and the second end portion of the reflective member and the second receiving portion of the stay are in direct contact with each other.

16. The fixing device according to claim 15, wherein the first receiving portion and the second receiving portion of the stay are located upstream and downstream of the nip region, respectively, in a conveying direction of the recording sheet.

17. The fixing device according to claim 15, wherein the first end portion of the reflecting member is disposed between the nip member and the first receiving portion of the stay, and the second end portion of the reflecting member is disposed between the nip member and the second receiving portion of the stay.

* * * * *